US005695076A

United States Patent [19]

Jay

[11] Patent Number: 5,695,076

[45] Date of Patent: Dec. 9, 1997

[54] REPLACEMENT TRACK FOR DISPLAY RACK

[75] Inventor: Richard Jay, Westport, Conn.

[73] Assignee: Display Technologies, Inc., Whitestone, N.Y.

[21] Appl. No.: 683,568

[22] Filed: Jul. 15, 1996

[51] Int. Cl.[6] ..... A47F 5/00

[52] U.S. Cl. ..... 211/59.2; 211/183; 312/42

[58] Field of Search ..... 211/59.2, 59.3, 211/183; 312/42, 45, 60

[56] References Cited

U.S. PATENT DOCUMENTS

| | | | |
|---|---|---|---|
| 1,758,098 | 5/1930 | Williams | 211/59.2 X |
| 2,996,344 | 8/1961 | Garman | 312/45 |
| 3,203,554 | 8/1965 | Rendergrast, Jr. et al. | 312/45 X |
| 3,477,774 | 11/1969 | Atwood | 312/45 |
| 4,598,828 | 7/1986 | Young et al. | 312/42 X |
| 4,785,943 | 11/1988 | Deffner et al. | 211/59.2 |
| 4,785,945 | 11/1988 | Rowse et al. | 312/42 X |
| 4,801,025 | 1/1989 | Flum et al. | 211/59.2 X |
| 4,923,070 | 5/1990 | Jackle et al. | 211/59.2 |
| 4,955,486 | 9/1990 | Trulaske, Sr. | 211/59.2 |
| 4,958,739 | 9/1990 | Spamer | 211/59.2 X |
| 4,997,094 | 3/1991 | Spamer et al. | 211/59.2 X |
| 5,022,535 | 6/1991 | Spamer | 211/59.2 |
| 5,024,336 | 6/1991 | Spamer | 211/59.2 |
| 5,050,748 | 9/1991 | Taub | 312/42 X |
| 5,531,336 | 7/1996 | Parham et al. | 211/183 |
| 5,562,217 | 10/1996 | Salveson et al. | 211/59.3 |

*Primary Examiner*—Robert W. Gibson, Jr.
*Attorney, Agent, or Firm*—Amster, Rothstein & Ebenstein

[57] ABSTRACT

A replacement track for a display track channel has a generally planar, slightly flexible, longitudinally elongate track member defining a front portion, a back portion, and a body portion connecting the front and back portions. The front portion defines a wedge-shaped front for lifting articles supported by an existing track of a channel above the existing track and on to the front portion as the front portion is moved between the articles and the existing track. The body portion defines a top surface, a bottom surface and a pair of longitudinal edges connecting the top and bottom surfaces, the body portion having biasing means on at least one longitudinal edge thereof for maintaining the track member in a channel and preferably on both longitudinal edges thereof for centering the body portion within the channel. At least the body portion defines on both the top and bottom surfaces thereof slide means for reducing the friction generated by an article sliding thereover, whereby the track may be used in a regular or inverted orientation in the channel. Preferably the front is generally convexly shaped and the back portion defines a plurality of removable longitudinal segments for enabling a reduction in the longitudinal length of the track member to fit in a channel.

12 Claims, 5 Drawing Sheets

REPLACEMENT TRACK FOR DISPLAY RACK

BACKGROUND OF THE INVENTION

The present invention relates to a track or floor for a display rack, and more particularly to a replacement track which is easily insertable.

With use, the floors or tracks of a display rack not only become worn away in parts by the bottles or other articles passing thereover, but also become clammy and sticky due to condensation, garbage, spillage and the like dropping thereon. While these signs of aging and use are undesirable in any display rack, they are especially undesirable in a gravity-fed display rack wherein the uneven wear or stickiness of a track could impede the easy movement of bottles or other articles down the channel.

If there are already bottles or other articles on a track to be replaced, these articles must first be removed from the track. Then a "replacement" track of whatever design is available is placed on the track to be replaced, centered relative to the side walls of the channel, and then glued or otherwise adhered to the track to be replaced so that the "replacement" track is held in place. Finally, as the last step, each of the articles removed from the channel must now be replaced in the channel atop the replacement track. Depending upon the number of articles that must be removed and replaced, it will appreciated that the substitution of a replacement track for an original track is a time consuming and bothersome process.

Further complicating the replacement procedure may be the need to trim the longitudinal length of the replacement track to meet the length of the channel. It is known to provide channels with breakaway or other removable end segments so that, even if a replacement track is designed for use with such a display rack, the longitudinal length of the channel on that display rack may have been altered by the user.

Still further complicating the replacement issue is the need of the user to maintain a good supply of the replacement tracks since, even after a replacement track has been installed, over time it may be necessary to remove the same and replace it with another replacement track. If one dispensed with the gluing or otherwise adhering of the "replacement" track to the original track, then the user would also need to maintain a supply of the replacement tracks in all of the different widths used for the original track. Clearly, the need exists for a "one size fits all" replacement track which could adjust to different width channels.

Accordingly, it is an object of the present invention to provide a replacement track for a display rack channel.

Another object is to provide such a replacement track which can be installed in the channel without initial removal of articles from the existing track and final placement thereof in the channel atop the replacement track.

A further object is to provide such a replacement track which, in a preferred embodiment, has means for centering and maintaining the same within the channel.

It is also an object of the present invention to provide such a replacement track which, in a preferred embodiment, enables a variable reduction in the longitudinal length thereof to enable it to fit within an existing channel.

It is another object to provide such a replacement track which, in a preferred "one size fits all" embodiment, can be used in a variety of channels of different widths.

It is a further object to provide such a replacement track which, in a preferred embodiment, after use of one side, can be turned over and used on the other side, thereby minimizing the need for separate replacement tracks.

SUMMARY OF THE INVENTION

It has now been found that the above and related objects of the present invention are obtained in a replacement track for a display rack channel. The replacement track comprises a generally planar, at least slightly flexible, longitudinally elongate track member defining a front portion, a back portion and a body portion connecting the front and back portions. The front portion defines a wedge-shaped front for lifting articles supported by an existing track of a channel above the existing track and on to the front portion as the front portion is moved between the articles and the existing track. The body portion defines a top surface, a bottom surface and a pair of longitudinal edges connecting the top and bottom surfaces, the body portion having biasing means on at least one longitudinal edge thereof for maintaining the track member in a channel. At least the body portion defines on both the top and bottom surfaces thereof slide means for reducing the friction generated by an article sliding thereover, whereby the track may be used in a regular or inverted orientation in the channel.

In a preferred embodiment, the front is generally convexly shaped. The back portion defines a plurality of removable longitudinal segments for enabling a reduction in the longitudinal length of the track member to fit in a channel, the back portion segments preferably being successively removable for variably reducing the longitudinal length of the track member. The body portion has biasing means on each longitudinal edge thereof for centering the track member in a channel, the biasing means being outwardly biased spring fingers which enable the replacement track to accommodate channels of different widths.

Preferably the slide means are a plurality of parallel, longitudinally extending ridges. Optimally, the front and back portions of the track member also define the slide means on the top and bottom surfaces thereof.

The present invention also encompasses in combination a display rack (comprising a transversely spaced pair of upstanding, longitudinally elongate sidewalls and a transversely extending, longitudinally elongate track joining the sidewalls) and a replacement track, as described above, intermediate the sidewalls and supported by the track.

BRIEF DESCRIPTION OF THE DRAWING

The above and related objects, features, and advantages of the present invention will be more fully understood by reference to the following detailed description of the presently preferred, albeit illustrative, embodiments thereof when taken in conjunction with the accompanying drawing wherein.

DETAILED DESCRIPTION OF THE PREFERRED EMBODIMENTS

Figure 1:
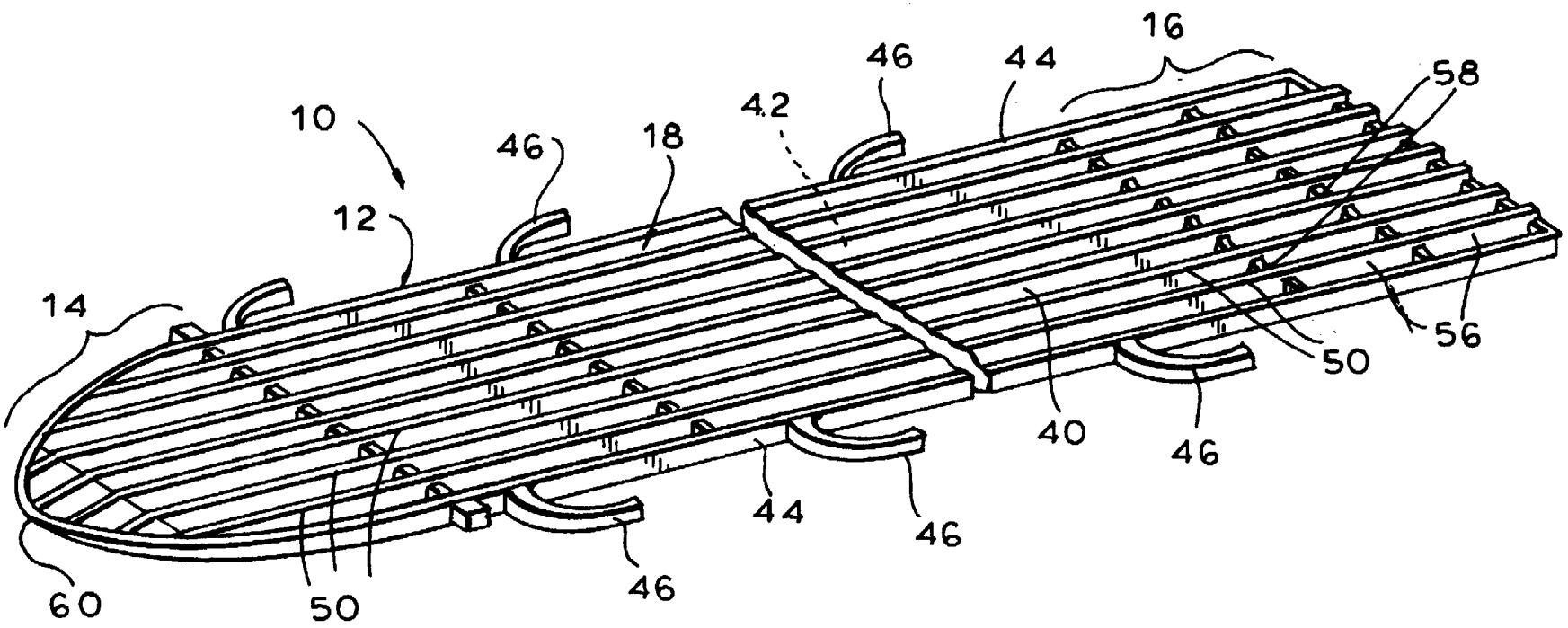
FIG. 1 is a fragmentary isometric view of a replacement track of the present invention.

Referring now to the drawing, and in particular to FIG. 1 thereof, therein illustrated is a replacement track according to the present invention, generally designated by the reference numeral 10. The replacement track 10 comprises a generally planar, longitudinally elongate track member generally designated 12 and configured and dimensioned to be positioned on top of an existing display rack channel. More particularly, the track member 12 defines a front portion generally designated 14, a back portion generally designated 16, and a body portion generally designated 18 and connecting the front and back portions 14, 16. For reasons which will become apparent hereinafter, the track member 12 is preferably at least slightly flexible along its longitudinal length so that the front portion 14 and the back portion 16 thereof may be bent upwardly slightly (and preferably resiliently) relative to the body portion 18.

Figure 2:
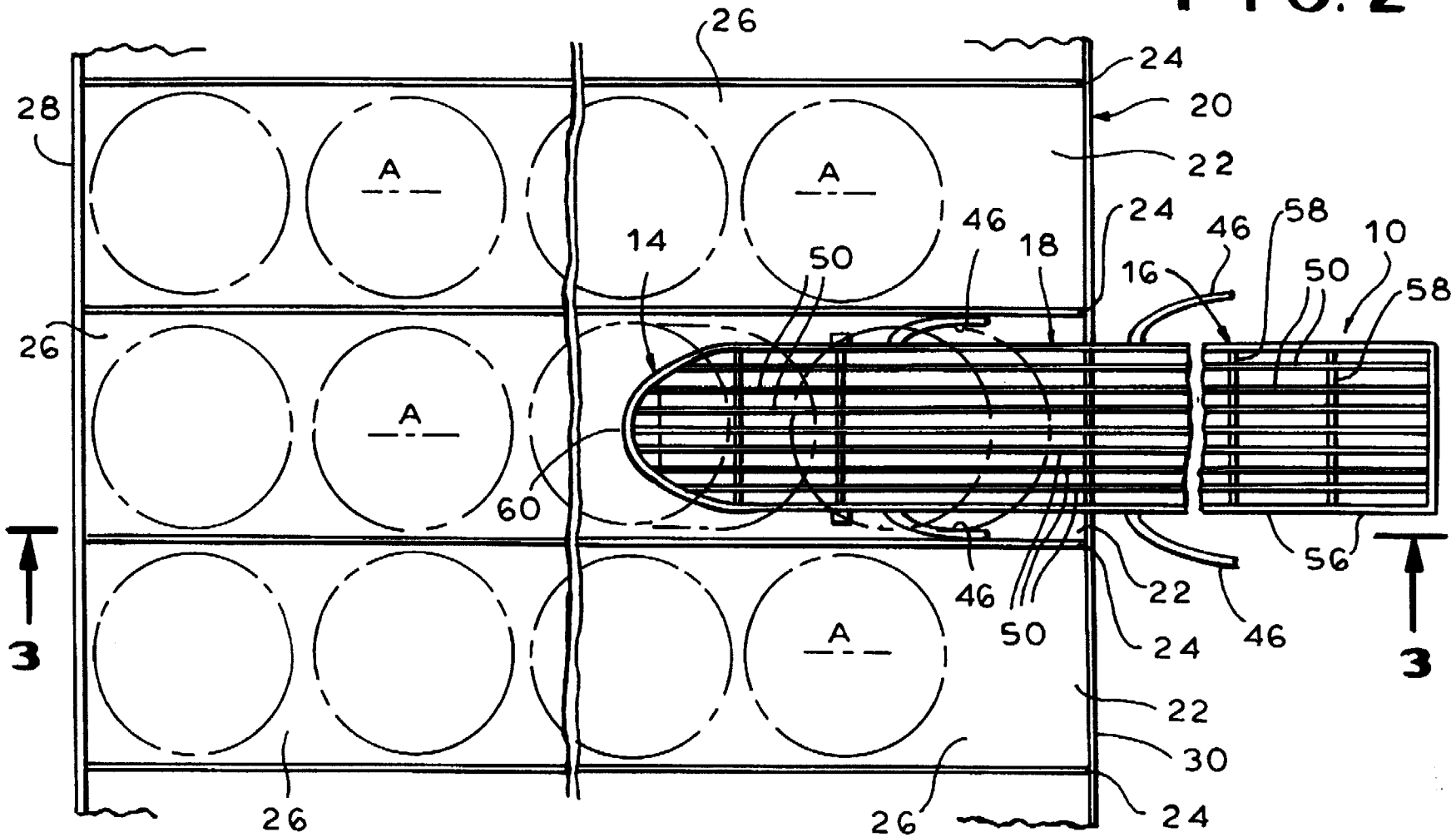
FIG. 2 is a fragmentary top plan view of a replacement track in the process of being inserted into a channel of a display rack, bottles in the several channels being indicated in phantom line.

Referring now to FIG. 2, the replacement track 10 is intended for use with a display rack, generally designated 20. Typically the display rack 20 defines a plurality of display rack channels 22 in parallel side-to-side disposition, with each channel 22 being defined by a pair of upstanding sidewalls or partition members 24, and an existing track or floor 26 extending between and connecting the sidewalls 24. At the front of each channel 22, an upstanding front wall 28 limits movements of bottles or like articles A down the channel 22, thereby to keep the bottoms of the articles on the track 26. At the back of each channel 22 an upstanding back wall or lip 30 is provided.

In a gravity-fed display rack typically the back wall or lip 30 serves little function beyond defining the back end of the channel 22. The channels 22 of the display rack 20 are typically filled with articles from the rear, with the articles being introduced into the channel by the retailer moving the same over the bottom wall or lip 30 and into the channel 22 proper so that they rest on the track 26 and slide forwardly under the influence of gravity. The back wall or lip 30 is merely a point of reference indicating to the retailer when the capacity of the channel has been reached. To some degree in a flat display rack, the back wall or lip 30 may also help to support in an upright orientation the last of the articles in the channel. (In a gravity-fed display rack, the back wall or lip 30 does not even perform this function as gravity automatically does so.) Accordingly, the top of the back wall or lip 30 is typically relatively low, much lower than the top of the front wall 28 of the channel.

At least the body portion 18 defines a top surface 40, a bottom surface 42, and a pair of longitudinal edges 44 connecting the top and bottom surfaces 40, 42. The body portion 18 has bias means 46 on at least one longitudinal edge 44 thereof for maintaining the track member 12 in a channel 22 by engagement with the sidewalls 24 thereof. The biasing means 46 enables the replacement track 10 to be of "one size fits all" design in that the variable maximum extension of the bias means 46 from the longitudinal edge 44 of the track member 12 enables the biasing means 46 to engage one sidewall 24 of the channel while the opposite longitudinal edge 44 of the track member engages the other sidewall 24 thereof. As illustrated, there are three biasing means 46 longitudinally spaced along each of the longitudinal edges 44. The disposition of the biasing means 46 on both longitudinal edges 44 provides automatic centering of the track member 12 in the channel 22. The biasing means 46 are illustrated as resilient spring fingers 46, the spring fingers 46 extending outwardly and rearwardly to facilitate insertion of the replacement track 10 in the channel 22 from the rear or back thereof. The front wall or lip 28 of the channel 22 limits the forward movement of the track member 12 in the channel 22, the downwardly sliding articles A assisting in maintaining the front of track member 12 adjacent the front of channel 22 during use thereof.

On the other hand, where the channel 22 is devoid of any front wall or lip 28 or the front wall or lip 28 at least accommodates passage therethrough of the replacement track 10, the replacement track 10 may be inserted into the channel 22 from the front thereof. In this instance, the sidewalls 24 of the channel 22 are preferably provided with locking means (such as recesses or apertures therethrough) and the spring fingers 46 are preferably provided along an outer portion thereof with locking means (such as outwardly extending tabs) so that the replacement track 10 and the channel sidewalls 24 can interlock (in a tab-and-recess or tab-and-aperture arrangement) to preclude accidental relative movement of the replacement track 10 relative to the channel 22 once it has been inserted.

While no biasing means 46 are illustrated on the front or back portions 14, 16, they may also be provided there, if desired.

At least the body portion 18 defines on both the top and bottom surfaces 40, 42 thereof slide means 50 for reducing the friction generated by an article sliding thereover. The friction-reducing slide means 50 is preferably a plurality of parallel, longitudinally extending ridges upstanding from the track member 12. Preferably the slide means 50 are provided on both the top and bottom surfaces of at least body portion 18 so that, after replacement track 10 has been in use for a period of time and the top surface 40 thereof now requires replacement, one has only to remove the replacement track 10 from the channel, turn it over, and replace it in the channel to provide a fresh, clean top surface (previously the bottom surface 42) over which the articles may travel within the channel 22. The ability to use each replacement track 10 twice minimizes the number of replacement tracks which must be manufactured, purchased, shipped and stored, thereby cutting expenses in various areas for all concerned. Where present on all three portions 14, 16 and 18, the ridges 50 of the front portion 14, rear portion 16 and body portion 18 are preferably in longitudinal alignment.

Typically it is not possible to remove the replacement track 12 from the channel 22 without first removing the articles therefrom and later replacing the articles on the new top surface of the inverted replacement track member 12. In order to avoid the extra effort involved in such a "turnover" of the replacement track member 12, however, the biasing means 46 may be especially designed so that they do not catch on the sidewalls 24 when the track member 12 is pulled rearwardly out of the channel 22. Thus, the articles resting on the replacement track 12 simply fall back onto the original track 26. At this point, the inverted replacement track member 12 may be reinserted between the original track 26 and the articles A resting thereon.

The back portion 16 defines a plurality of removable longitudinal segments 56 for enabling a reduction in the longitudinal length of the track member 12 so as to enable it to fit in a channel 22. As illustrated, the back portion segments 56 are breakaway segments. At the front of each of the back portion segments 56 is a line of weakness 58 which enables the adjacent back portion segment 56 to be easily and cleanly broken off, much as breakaway back portions are provided on certain display racks. The back portion segments 56 are successively removable so as to enable reducing the longitudinal length of the track member segment by segment until it fits into the channel. Preferably the back portion segments 56 include slide means 50 to facilitate movement of the articles thereover.

The front portion 14 defines a wedge shaped front 60 for lifting articles supported by an existing track of a channel 22 above the existing track and on to the front portion 14 as the front portion 14 is moved between the articles and the existing track. The wedge shape is defined by a forwardly and upwardly bevelled bottom surface and a forwardly and downwardly bevelled top surface. The front 60 is also generally convexly shaped to conform to the generally convexly curved front commonly found on the original tracks of display rack channels. The term "generally convexly curved" as used herein encompasses a chevron shape or arrowhead shape as well as a smoothly convex curve. The convex curvature reduces the effort required to initially lift articles off an existing track of a channel, above the existing track and on to the front portion 14 as the front portion 14 is moved between the articles and the existing track. The combination of the chisel-shape and convex curvature of the front 60 facilitates the insinuation of the front portion 14 between the articles and the existing track. Preferably the front portion 14 includes slide means 50 to facilitate movement of the articles thereover.

Figure 3:
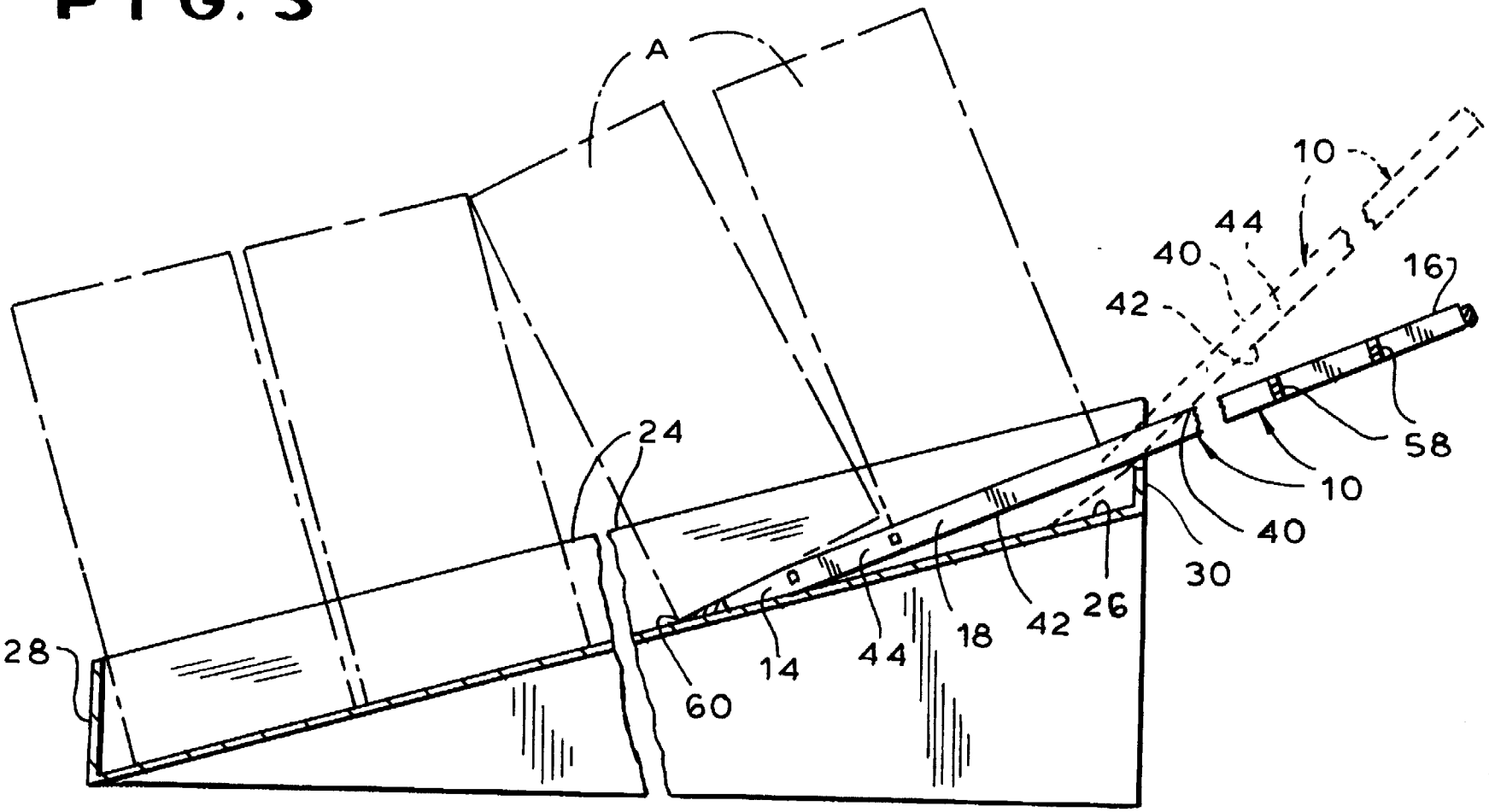
FIG. 3 is a sectional view taken along the line 3—3 of FIG. 2, with the initial position of the replacement track being illustrated in phantom line.
Figure 4:
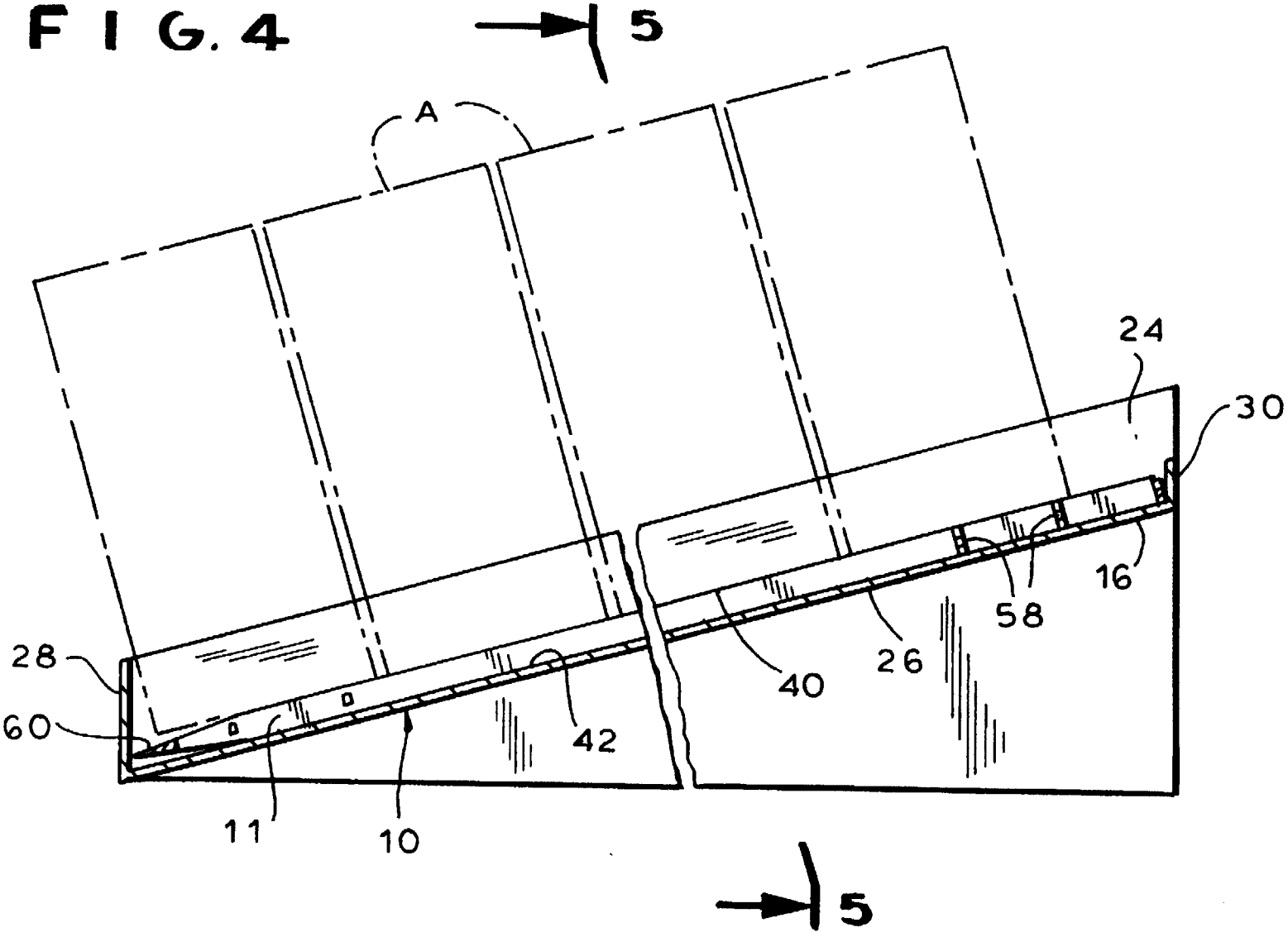
FIG. 4 is a fragmentary side elevation view of the channel with the replacement track in place.
Figure 5:
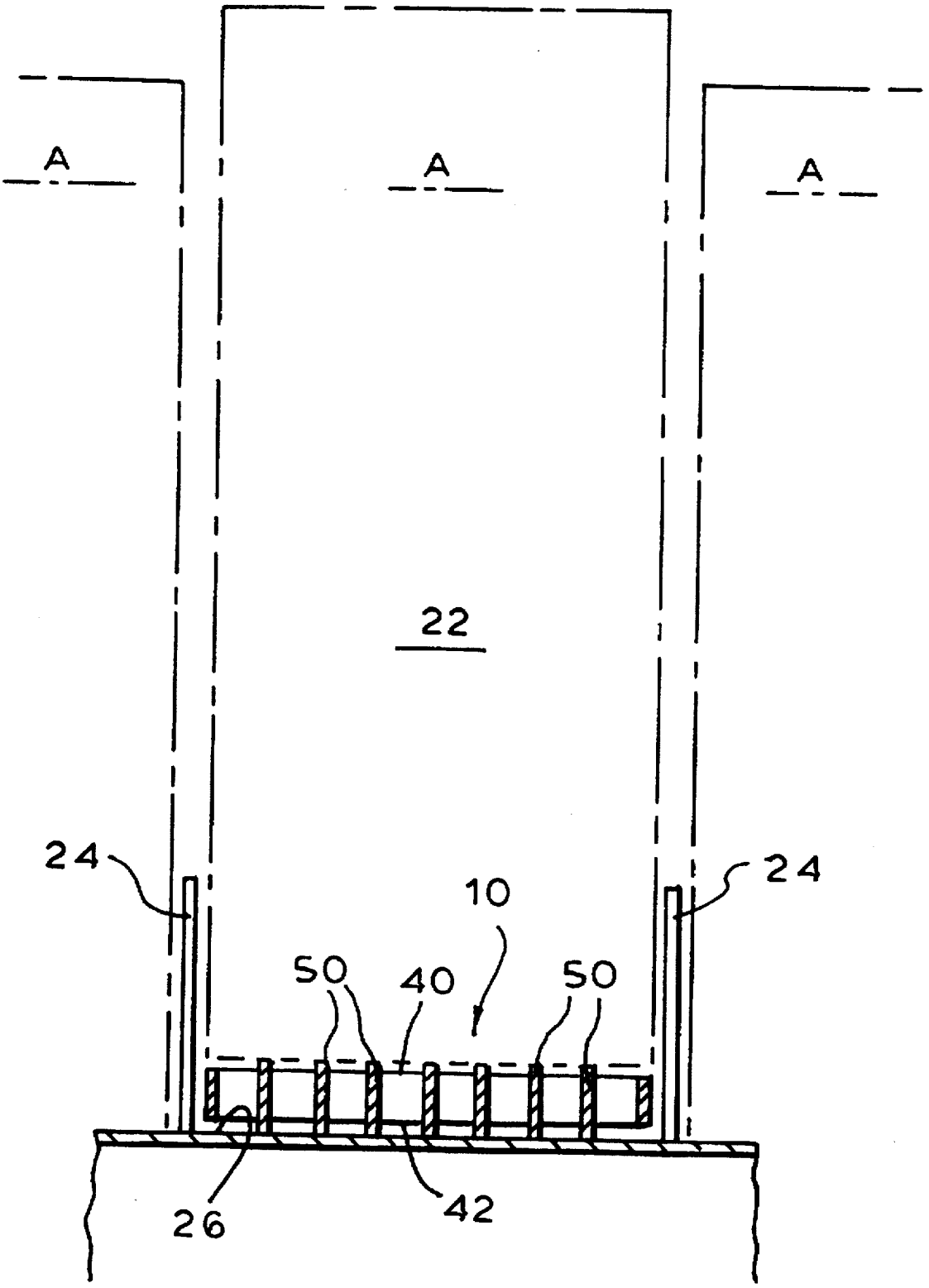
FIG. 5 is a sectional view taken along the line 5—5 of FIG. 4.

Referring now to FIGS. 2 and 3, to insert the replacement track 10 in an existing channel, the front portion 14 of the replacement track 10 is placed over (and usually on) the back wall or lip 30 of the channel 22 and slid forwardly and downwardly against the existing track 26, especially where the articles A meet the existing track 26. The front portion 14 is oriented so that the bottom surface of the front 60 is flat against the existing track 26, optionally with the slide means 50 of the replacement track 10 slightly offset from those of the existing track 26 to enable a closer fit. Then the replacement track 10 is forcibly moved forwardly so that the upper surface of the front 60 lifts the articles successively, allowing them to move rearwardly over the front portion 14 as the front 16 moves between the next article A and the existing track 26. The limited flexibility of the track member 12 facilitates positioning of the replacement track 10 over the back wall or lip 30 and at the intersection of the articles A and the existing track 26, with the replacement track 10 being at an appropriate angle for further forward and lifting motion when it is moved forwardly by the user until it reaches the fully inserted position illustrated in FIGS. 4 and 5.

If the channel 22 is almost entirely filled with articles, it may be necessary to remove one or two of the articles from the rear thereof so as to enable the front 60 of the replacement track 10 to assume a desirable orientation for insinuating itself between the articles and the existing track.

To summarize, the present invention provides a replacement track for a display track channel, the replacement track being installable in the channel without initial removal of articles from the existing track and final placement thereof in the channel atop the replacement track. The replacement track, in a preferred embodiment, includes means for centering and maintaining the same within a variety of existing channels, means enabling a variable reduction in the width thereof so as to enable it to fit within a variety of existing channels, means enabling a variable reduction in the longitudinal length thereof so as to enable it to fit within an existing channel, and slide means on both sides so that, after use on one side, it can be turned over and used on the other side to minimize the need for separate replacement tracks.

Now that the preferred embodiments of the present invention have been shown and described in detail, various modifications and improvements thereon will become readily apparent to those skilled in the art. Accordingly, the present invention is to be construed broadly and limited only by the appended claims, and not by the foregoing specification.

I claim:

1. A replacement track for a display rack channel, said replacement track comprising:

a generally planar, at least slightly flexible, longitudinally elongate track member defining a front portion, a back portion and a body portion connecting said front and back portions;

(i) said front portion defining a vertically wedge-shaped front for lifting articles supported by an existing track of a channel above the existing track and on to said front portion as said front portion is moved between the articles and the existing track; and (ii) said body portion defining a top surface, a bottom surface and a pair of longitudinal edges connecting said top and bottom surfaces, said body portion having biasing means on at least one longitudinal edge thereof for maintaining said track member in a channel;

at least said body portion defining on both said top and bottom surfaces thereof slide means for reducing the friction generated by an article sliding thereover; whereby said track may be used in a regular or inverted orientation in the channel.

2. The replacement track of claim 1 wherein said front is horizontally generally convexly shaped.

3. The replacement track of claim 1 wherein said back portion defines a plurality of removable longitudinal segments for enabling a reduction in the longitudinal length of said track member to fit in a channel.

4. The replacement track of claim 3 wherein said back portion segments are successively removable for variably reducing the longitudinal length of said track member.

5. The replacement track of claim 1 wherein said body portion has biasing means on each longitudinal edge thereof for engaging sidewalls of a channel above the existing track and centering said track member in the channel.

6. The replacement track of claim 5 wherein said biasing means are outwardly biased spring fingers.

7. The replacement track of claim 1 wherein said slide means are a plurality of parallel, longitudinally extending ridges.

8. The replacement track of claim 1 wherein said front and back portions of said track member also define said slide means on the top and bottom surfaces thereof.

9. The replacement track of claim 1 wherein said biasing means extend outwardly from said at least one longitudinal edge of said body portion a variable distance so that said replacement track fits a variety of channels of different widths.

10. A display rack comprising:

(A) a transversely spaced pair of upstanding, longitudinally elongate sidewalls and a transversely extending, longitudinally elongate track joining said sidewalls; and (B) the replacement track of claim 1 intermediate said sidewalls and supported by said elongate track.

11. A replacement track for a display rack channel, said replacement track comprising:

a generally planar, at least slightly flexible, longitudinally elongate track member defining a front portion, a back portion and a body portion connecting said front and back portions;

(i) said front portion defining a vertically wedge-shaped and horizontally generally convexly shaped front for lifting articles supported by an existing track of a channel above the existing track and on to said front portion as said front portion is moved between the articles and the existing track;

(ii) said back portion defining a plurality of removable longitudinal segments for enabling a reduction in the longitudinal length of said track member to fit in a channel, said back potion segments being successively removable for variably reducing the longitudinal length of said track member; and (iii)said body potion defining a top surface, a bottom surface and a pair of longitudinal edges connecting said top and bottom surfaces, said body potion having outwardly biased spring finger means on each longitudinal edge thereof for engaging sidewalls of a channel above the existing track, for accommodating channels of different widths and for centering and maintaining said track member in a channel;

said front portion, said body portion and said back portion defining on both said top and bottom surfaces thereof slide means for reducing the friction generated by an article sliding thereover, said slide means being a plurality of parallel, longitudinally extending ridges, whereby said track may be used in a regular or inverted orientation in the channel.

12. A display rack comprising:

(A) a transversely spaced pair of upstanding, longitudinally elongate sidewalls and a transversely extending, longitudinally elongate track joining said sidewalls; and (B) the replacement track of claim 11 intermediate said sidewalls and supported by said elongate track.

* * * * *